US012292256B2

(12) United States Patent
Cogan et al.

(10) Patent No.: US 12,292,256 B2
(45) Date of Patent: May 6, 2025

(54) ADJUSTABLE FIREARM BALANCE WEIGHT SYSTEM

(71) Applicant: Cogan Firearms LLC, Warminster, PA (US)

(72) Inventors: Daniel E. Cogan, Warminster, PA (US); James J. Weimer, Warminster, PA (US)

(73) Assignee: Cogan Firearms LLC, Warminster, PA (US)

( * ) Notice: Subject to any disclaimer, the term of this patent is extended or adjusted under 35 U.S.C. 154(b) by 0 days.

(21) Appl. No.: 18/214,916

(22) Filed: Jun. 27, 2023

(65) Prior Publication Data

US 2024/0167784 A1 May 23, 2024

Related U.S. Application Data

(60) Provisional application No. 63/427,228, filed on Nov. 22, 2022.

(51) Int. Cl.
*F41C 27/22* (2006.01)
*F41C 23/16* (2006.01)

(52) U.S. Cl.
CPC ..... *F41C 27/22* (2013.01); *F41C 23/16* (2013.01)

(58) Field of Classification Search
CPC ..... F41C 27/22
See application file for complete search history.

(56) References Cited

U.S. PATENT DOCUMENTS 404,921 A * 6/1889 Miller ..... F41C 27/22 42/71.01
1,437,797 A * 12/1922 Fisher ..... F41C 27/22 42/112
2,140,945 A * 12/1938 Swartz ..... F41C 27/22 42/97
2,921,396 A * 1/1960 Larson ..... F41C 27/22 42/97
3,604,136 A * 9/1971 Edwards ..... F41C 27/22 42/97
5,678,345 A * 10/1997 Gnade ..... F41C 27/22 42/97
6,490,822 B1 * 12/2002 Swan ..... F41C 23/16 42/75.01
6,499,245 B1 * 12/2002 Swan ..... F41G 11/003 42/75.01
8,935,874 B2 * 1/2015 Troy ..... F41G 11/003 42/96
9,464,866 B1 * 10/2016 Liang ..... F41A 21/20
9,689,646 B1 * 6/2017 Story ..... F41C 27/00
9,772,161 B1 * 9/2017 Cheng ..... F41G 11/004
9,989,328 B2 * 6/2018 Ding ..... F41A 35/02
10,641,575 B1 * 5/2020 Coulombre ..... F41C 27/00
(Continued)

*Primary Examiner* — Derrick R Morgan
(74) *Attorney, Agent, or Firm* — Buchanan Ingersoll & Rooney PC

(57) ABSTRACT

An adjustable firearm balance weight system comprising: a balance weight configured to secure to a part of a firearm in at least two alternative positions relative to the part of the firearm; and a lock system configured to hold the balance weight in each of the at least two alternative positions relative to the part of the firearm, wherein the lock system is configured to be operated, preferably by hand and without tools, to allow the balance weight to move between the at least two alternative positions.

13 Claims, 7 Drawing Sheets

(56) References Cited

U.S. PATENT DOCUMENTS 11,215,421 B1* 1/2022 Coulombre ..... F41A 23/005
11,371,803 B2* 6/2022 Michal ..... F41C 27/00
11,754,363 B1* 9/2023 Hodgson ..... F41A 27/28
235/407
2003/0106252 A1* 6/2003 Hines ..... F41A 35/02
42/90
2008/0301994 A1* 12/2008 Langevin ..... F41C 23/16
42/71.01
2010/0186278 A1* 7/2010 Daniel ..... F41C 23/16
42/71.01
2011/0099873 A1* 5/2011 Bentley ..... F41G 11/003
42/71.01
2012/0159831 A1* 6/2012 LaFrance ..... F41G 11/003
42/90
2012/0311906 A1* 12/2012 Troy ..... F41C 23/16
42/71.01
2013/0104438 A1* 5/2013 Hines ..... F41C 27/00
42/84
2013/0104439 A1* 5/2013 Hines ..... F41C 27/00
42/84
2014/0041273 A1* 2/2014 Masters ..... F41C 23/16
42/71.01
2014/0130390 A1* 5/2014 Geissele ..... F41C 23/16
42/71.01
2014/0325889 A1* 11/2014 Michal ..... F41C 27/00
42/75.01
2015/0247700 A1* 9/2015 Merlino ..... F41C 23/16
42/75.01
2015/0316354 A1* 11/2015 Cheng ..... F41C 27/00
42/90
2016/0116246 A1* 4/2016 Daniel ..... F41C 23/16
42/90
2016/0169610 A1* 6/2016 Hines ..... F41A 35/00
42/90
2016/0209162 A1* 7/2016 Geissele ..... F41C 23/02
2016/0216061 A1* 7/2016 Cheng ..... F41C 27/00
2016/0223286 A1* 8/2016 Storch ..... F41G 11/001
2016/0298925 A1* 10/2016 Gottzmann ..... F41C 23/16
2017/0023329 A1* 1/2017 Gottzmann ..... F41C 23/16
2017/0059273 A1* 3/2017 Geissele ..... F41C 23/16
2017/0082395 A1* 3/2017 Roberts ..... F41C 33/006
2017/0082396 A1* 3/2017 Geissele ..... F41C 27/22
2018/0202759 A1* 7/2018 Samson ..... F41A 3/66
2018/0347933 A1* 12/2018 Molina ..... F41A 35/02
2019/0017775 A1* 1/2019 Roberts ..... F41G 11/001
2019/0226799 A1* 7/2019 Hubbell ..... F41C 27/00
2019/0249948 A1* 8/2019 Cahill ..... F41C 27/00
2020/0033091 A1* 1/2020 Michal ..... F41C 27/00
2020/0224998 A1* 7/2020 Kincel ..... F41C 23/16
2021/0389080 A1* 12/2021 McMillan ..... F41C 33/029
2022/0325968 A1* 10/2022 Cabahug ..... F41G 11/003
2022/0325980 A1* 10/2022 Walker ..... F41C 23/18
2024/0003656 A1* 1/2024 Martz ..... F41C 27/22
2024/0255252 A1* 8/2024 Farris ..... F41C 23/16

* cited by examiner

Fig. 4a
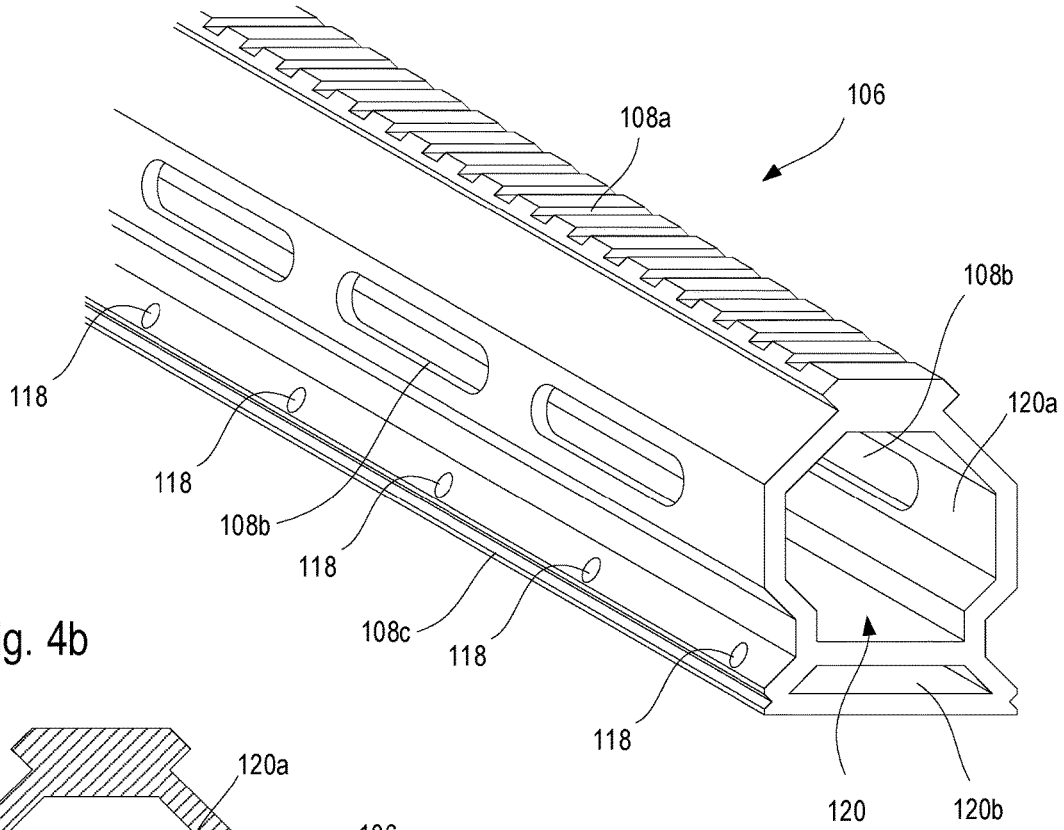
Fig. 4b
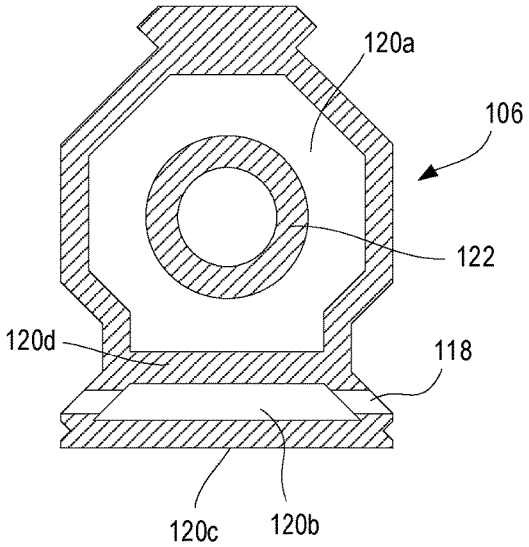
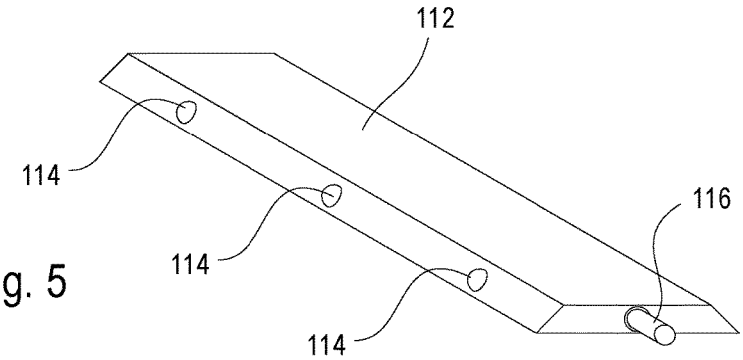
Fig. 5

ADJUSTABLE FIREARM BALANCE WEIGHT SYSTEM

This application claims the benefit of U.S. Provisional Application Ser. No. 63/427,228, filed Nov. 22, 2022, which is incorporated by reference herein in its entirety.

BACKGROUND

Firearms can be modified or adjusted to address the user's particular preferences. One such modification is to change the weight and/or weight distribution of the firearm. For example, weights for a shotgun can be attached to the barrel, attached to a forend cap or installed within the stock. As still another example, certain pistols can have a weighted guide rod installed to help reduce muzzle rise. As another example, a balance weight can be attached to the forward end of a rifle to provide better balance and stability, reduce barrel lift, and assist with reducing the felt recoil of the firearm. Such weights often are used with competition firearms, but other applications are known.

Balance weights can take various forms, such as solid metal weights (lead, steel, aluminum, etc.), and dynamic weights having a motion damper (e.g., mercury in a sealed chamber). An example of a firearm weight system is provided in United States Patent Publication No. 2016/0209162A1, which is incorporated by reference herein, and which describes a system having one or more weights that hug the interior surface of the firearm rail.

Balance weights must be firmly fixed into place on the firearm to prevent movement or release during the typically rigorous use of the firearm. Consequently, balance weights are not movable or adjustable without using tools to remove fasteners (e.g. screws, bolts), and/or completely removing or reassembling the weight system (e.g., disassembling, adjusting and reinstalling a forend cap weight on a shotgun).

The inventor has determined that an adjustable balance weight system can be provided with a simple tool-less adjustment mechanism, and without being subject to unexpected release or movement.

SUMMARY

Exemplary embodiments provide an adjustable firearm balance weight system comprising: a balance weight configured to secure to a part of a firearm in at least two alternative positions relative to the part of the firearm; and a lock system configured to hold the balance weight in each of the at least two alternative positions relative to the part of the firearm, wherein the lock system is configured to be operated, preferably by hand and without tools, to allow the balance weight to move between the at least two alternative positions.

Variations and other exemplary embodiments are described in more detail in the following description.

BRIEF DESCRIPTION OF THE DRAWINGS

FIGS. 4A and 4B show a first exemplary embodiment of a rifle hand guard configured to couple with a tool-free adjustable balance weight system.

FIG. 5 shows a first exemplary embodiment of a tool-free adjustable balance weight system.

DESCRIPTION OF EXEMPLARY EMBODIMENTS

Examples of embodiments are described herein with reference to the accompanying drawings, in which like reference numbers represent like features of different embodiments. In some cases, like features are not indicated by reference numbers, so as to make the drawings less complicated and easier to comprehend.

Certain embodiments may be used with a variety of firearms, such as bolt-action rifles, semi-automatic rifles, automatic rifles, shotguns, carbines, pistols, and so on, as will be understood by a person of skill in the art. Certain embodiments also may be used at various location(s) on the firearm (e.g., the stock). For simplicity, the embodiments described herein relate to using a balance weight system on the forward end of a rifle.

Figure 1:
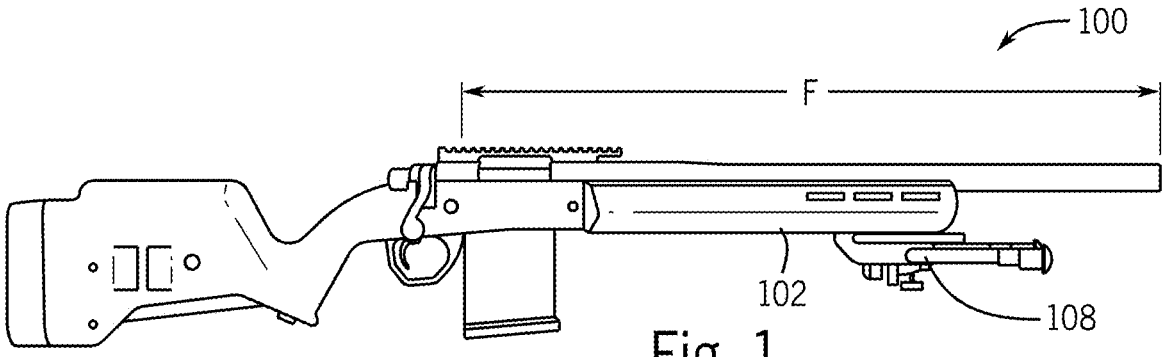
Fig. 1 (prior art)
FIG. 1 shows an exemplary bolt-action rifle.
Figure 2:
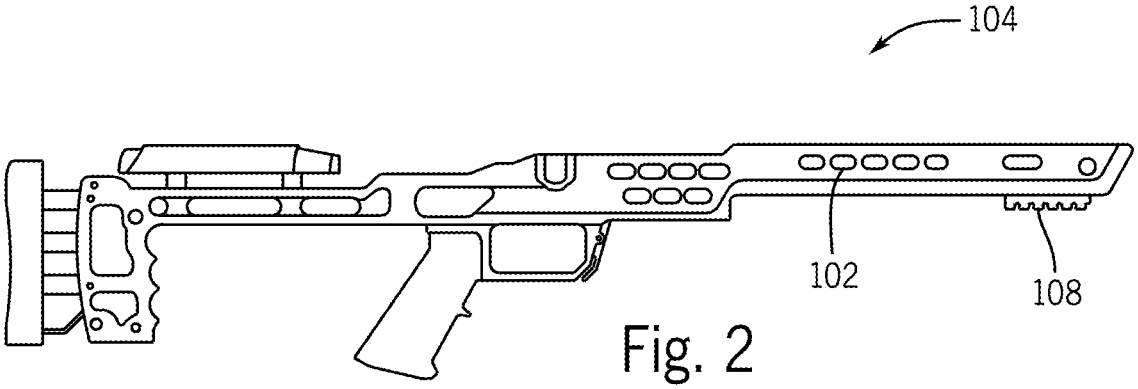
Fig. 2 (prior art)
FIG. 2 shows an exemplary rifle chassis.
Figure 3:
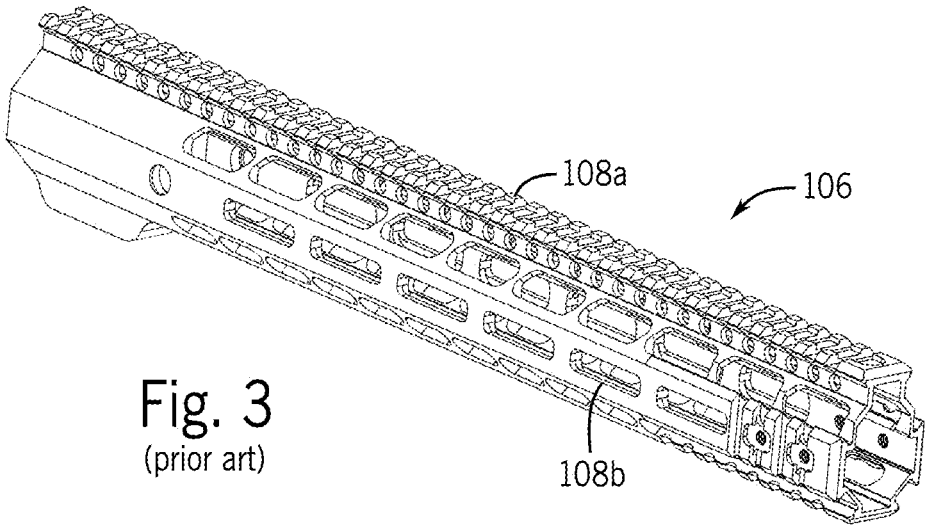
Fig. 3 (prior art)
FIG. 3 shows an exemplary rifle hand guard.
Figure 6:
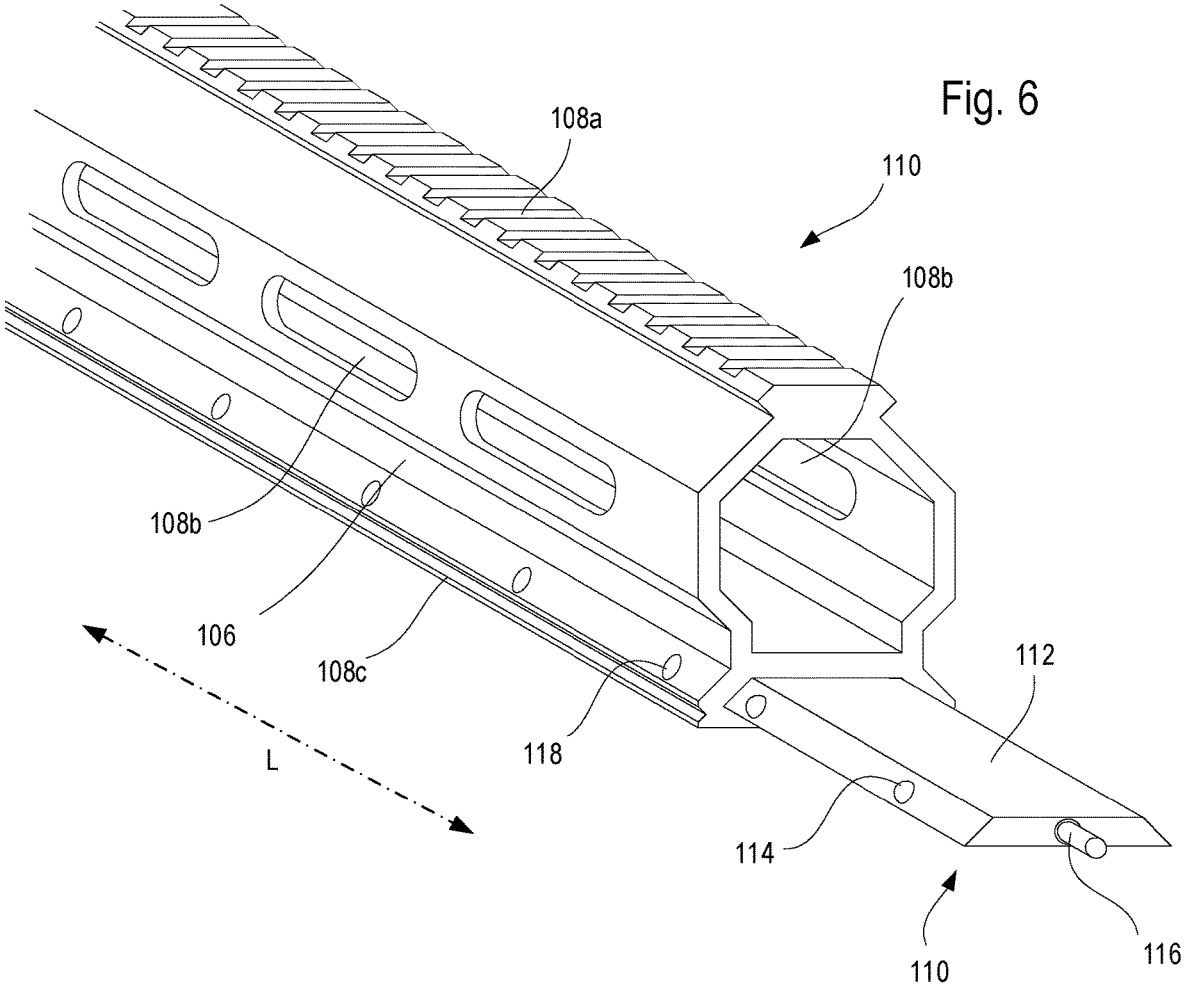
FIG. 6 shows the tool-free adjustable balance weight system of FIG. 5 inserted internally to the rifle hand guard of FIG. 4.

FIGS. 1 to 3 show various rifle components to which an adjustable balance weight system can be attached. FIG. 1 shows an exemplary bolt-action rifle 100 having a stock with a forend 102. FIG. 2 shows an exemplary rifle chassis 104, also having a forend 102. FIG. 3 shows a rifle hand guard 106, which is configured to be mounted to a rifle such as rifle 100, surrounding a barrel, and generally in a location corresponding to the rifle and chassis forends 102 shown in FIGS. 1 and 2. Other arrangements may use a combined hand guard and/or upper or lower receiver configurations to act as a forward end of a rifle or other firearm.

In each of FIGS. 1-3, one or more rail systems (such as Picatinny and weaver rail systems) or accessory mounts 108 may be provided at a location corresponding to the forward end F (in front of the trigger) of the firearm such as rifle 100. In FIGS. 1 and 2, accessory mount 108 is a relatively short rail-like structure that is secured to the lower side of the forend 102. In some cases, multiple separate accessory mounts 108 may be provided at different locations around the forward region (e.g., top and bottom, bottom and one or both sides, etc.). For example, in FIG. 3, a relatively long rail system (e.g. a full length rail system) serves as upper accessory mount 108*a* and is provided on what will be the upper side of the forward region of s rifle when hand guard 106 is installed on the rifle. Other accessory mounts 108*b* (such as M-LOK, KeyMod, quad rail) are located around one or more other surfaces of hand guard 106. Such accessory mounts are commonly used to mount optics, lights, grips, tripods, sling mounts, and other accessories.

The accessory mounts 108 may be separate parts that are secured in place directly to the rest of the firearm, or secured via an intermediate accessory mount 108. For example, it is known to secure one type of accessory mount 108 to another type of accessory mount 108 that is already on the firearm (e.g., installing a dovetail-type rail onto a Picatinny-type rail or a Picatinny rail piece onto an M-Lok mount)). The accessory mount 108 also may be integrally formed with other parts of the firearm. For example, hand guard 106 may comprise an extruded and/or machined structure having accessory mount 108 or mounts integrally formed with the remainder of hand guard 106. As another example, a forend 102 of a rifle stock or chassis can be shaped to include an accessory mount 108 portion that allows attachment of accessories.

Accessory mount 108 may have any suitable construction for holding accessories to the firearm. Examples include Picatinny rails (i.e., a MIL-STD-1913 rail), dovetail rails (e.g., Weaver rails or dovetail-type rails as provided by, e.g., Really Right Stuff of Lehi, Utah), open space rails (e.g., M-Lok rails), T-slots (e.g., UIT rails), and so on.

Tool-free balance weight systems of the present invention may be used on any variety of accessory mount 108, and on any type of firearm. However, for simplicity, exemplary embodiments beginning at FIG. 4 are described as used on an exemplary rifle hand guard 106.

Referring now to FIGS. 4A through 6, an example of a hand guard 106 and a balance weight system 110 are shown in several views.

Hand guard 106 includes an upper accessory mount 108*a* in the form of a Picatinny rail, side accessory mounts 108*b* in the form of M-Lok style openings, and a lower accessory mount 108*c* in the form of a dovetail rail. Accessory mounts 108*a*, 108*b*, 108*c* are all integrally formed with hand guard 106, but alternatively one or more of accessory mounts 108*a*, 108*b*, 108*c* may be provided separately and attached via fasteners (e.g. a Picatinny or dovetail rail secured by screws to a surface of the hand guard 106) or by an intermediate accessory mount (e.g., a dovetail rail secured to a Picatinny rail or via a M-Lok system). In other cases, one or more of accessory mounts 108*a*, 108*b*, 108*c* may be omitted or moved to different positions.

Exemplary balance weight system 110 includes a balance weight 112 and a lock system configured to hold balance weight 112 in each of at least two alternative positions relative to hand guard 106. The lock system is preferably configured to be operated by hand and without tools, to allow the balance weight to move between the at least two alternative positions.

Balance weight 112 is dimensioned to fit within a corresponding chamber 120 in hand guard 106. Chamber 120 extends along a longitudinal sliding axis L extending along the fore-aft length of hand guard 106. Chamber 120 includes a first region 120*a* configured to surround a barrel 122 of the firearm, and a second region 120*b* that is adjacent to first region 120*a* and configured to sliding receive balance weight 112. Chamber 120*b* alternatively may be provided as a separate accessory mount that is attached to hand guard 106, be integrated into another accessory mount, such as by being defined by a passage extending through dovetail-type lower accessory mount 108*c*, or be defined by a partially-closed chamber that faces outside hand guard 106 (e.g., lower chamber wall 120*c* may be omitted. First region 120*a* and second region 120*b* also may be entirely or partially open to each other, such as by omitting the internal wall 120*d* that divides first region 120*a* from second region 120*b*. Exemplary chamber 120 is shown having a trapezoidal profile, but other shapes (e.g., ovate, triangular, hexagonal, rectangular, etc.) may be used. Other alternatives and embodiments will be apparent to persons of ordinary skill in the art in view of the present disclosure.

Balance weight 112 may comprise a monolithic block of material (e.g., tungsten, lead, steel or aluminum), or a combination of materials or parts (e.g., a steel carrier body with permanent or removable tungsten, lead or aluminum inserts). Balance weight 112 also may include a damping system, such as a sealed reservoir containing mercury that can move in reaction to discharge forces, or internal springs and movable internal weights to mitigate felt recoil.

The lock system is configured to hold balance weight 110 at two or more alternative positions relative to hand guard 106. In the shown example, the lock system comprises one or more lock protrusions 114 that can be selectively moved into and out of engagement with corresponding detents 118. Lock protrusions 114 are provided as pins or ball bearings, and detents 118 are provided as holes that are drilled through hand guard 106, as shown in the cross-section view of FIG. 4B. Multiple lock protrusions 114 are provided along balance weight 112, and are arranged to extend along sliding axis L. Similarly, multiple detents 118 are provided in hand guard 106, and arranged to extend along sliding axis L. Protrusions 114 and detents 118 are spaced and positioned to engage each other at multiple locations of balance weight 112 relative to hand guard 106.

Lock release 116 operates to selectively release and engage protrusions 114 with detents 118, to thereby secure balance weight 112 in one of the multiple available positions. In this example, lock protrusions 114 extend from the outer surface of balance weight 112 and into respective ones of detents 118, to thereby secure balance weight 112 in the chosen position along the length of hand guard 106. When it is desired to move balance weight system 110, the user operates lock release 116 to allow lock protrusions 114 to retract towards (and possibly beneath) the outer surface of balance weight 112, and out of detents 118. With lock protrusions 114 retracted, balance weight system 110 can be slid to a new position along the length of chamber 120. Once in the new position, lock release 116 is positioned to hold protrusions 114 into a set of detents 118 corresponding to the new position.

Figure 7:
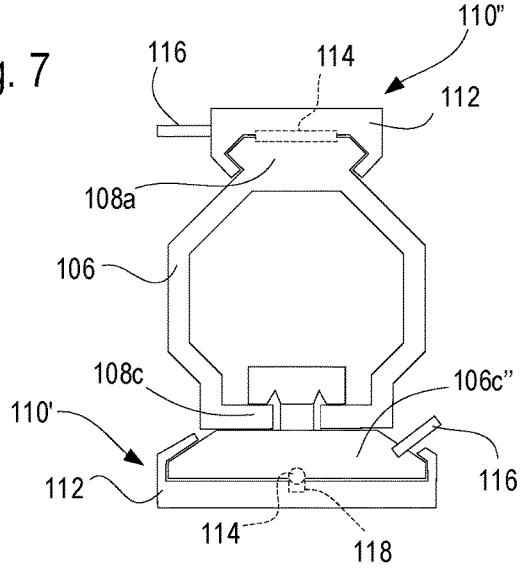
FIG. 7 shows exemplary embodiments of tool-free adjustable balance weight systems attached externally to the rifle hand guard of FIG. 4.

FIG. 7 shows two alternative embodiments of balance weight systems 110', 110". Alternative balance weight systems 110', 110" are mounted externally to hand guard 106, rather than internally as shown in the foregoing example.

The first alternative balance weight system 110' is mounted externally to lower accessory mount 108*d* in the form of a dovetail-type rail that is secured to an open space-type accessory mount 108*c* (e.g., an M-lok style mount) located at the bottom of hand guard 106. As before, balance weight system 110' includes one or more protrusions 114 that can engage one or more corresponding detents 118 to hold balance weight 112 in the desired position. However, in this case, lock 114 comprises lock protrusions 114 that extend from lower accessory mount 108*d*, and detents 118 are formed in balance weight 112. Lock release 116 is also provided on accessory mount 108*d*, and, as before, is operable to disengage protrusions 114 to allow balance weight 112 to be moved to a new position along the length of hand guard 106. In addition to showing an externally-mounted balance weight 112, this embodiment demonstrates that a complete balance weight system 110' can be provided as a separate assembly that can be mounted to an existing hand guard 106 or other parts of a firearm.

The second alternative balance weight system 110" in FIG. 7 is mounted externally to an upper accessory mount 106*a* in the form of a Picatinny rail that is integrally formed on hand guard 106 (e.g., by machining or forming it as part of the hand guard 106 extrusion profile). In this case, protrusion 114 comprises an elongated pin or roller that selectively engages pre-existing detents 118 defined as part of hand guard 106 to hold balance weight 112 in the desired location. The pre-existing part may comprise, for example, slots located along the Picatinny rail (see FIGS. 4*a* and 6), vent openings (not shown) along the length of hand guard 106, and so on. As before, balance weight system 110" includes a lock release 116 to selectively disengage protrusions 114 from corresponding detents.

Figure 8A:
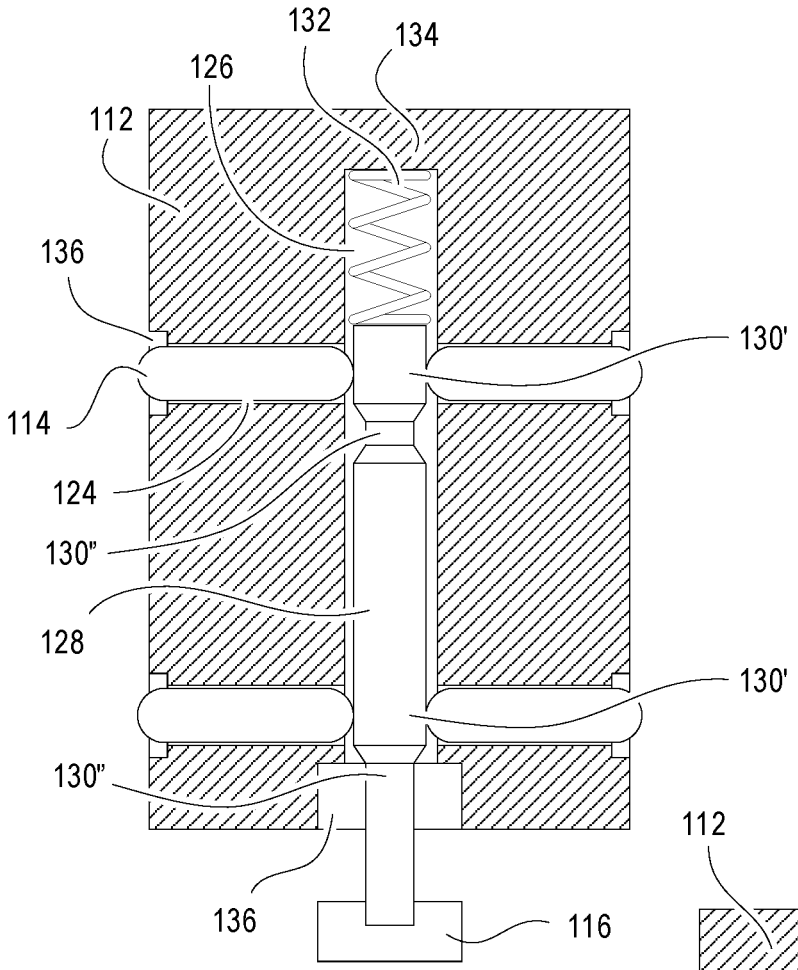
FIGS. 8A and 8B show an exemplary embodiment of a lock and lock release that may be used in embodiments of tool-free adjustable balance weight systems.
Figure 8B:
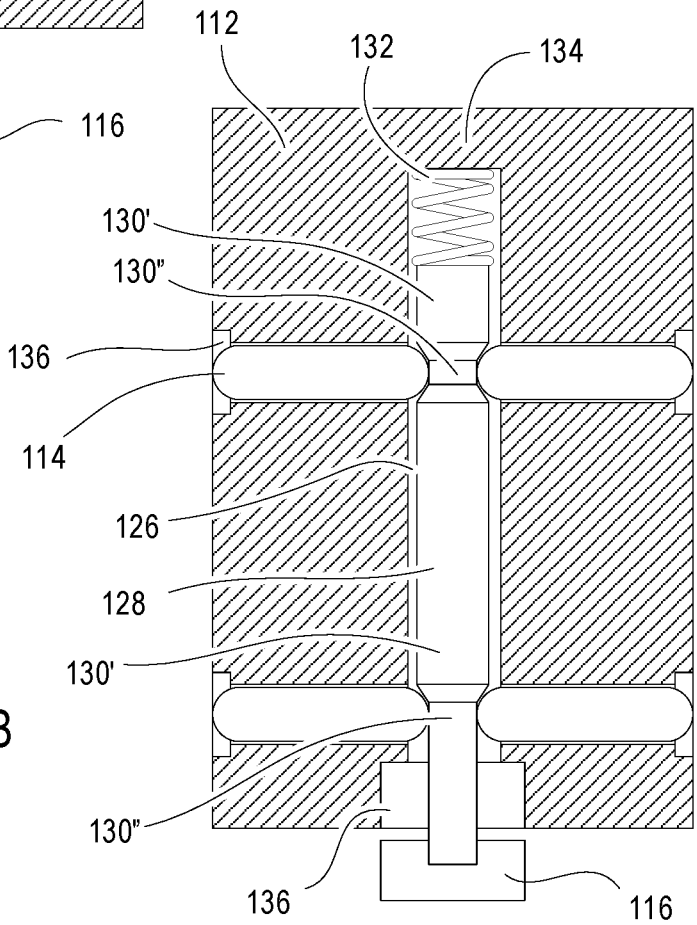
Figure 9:
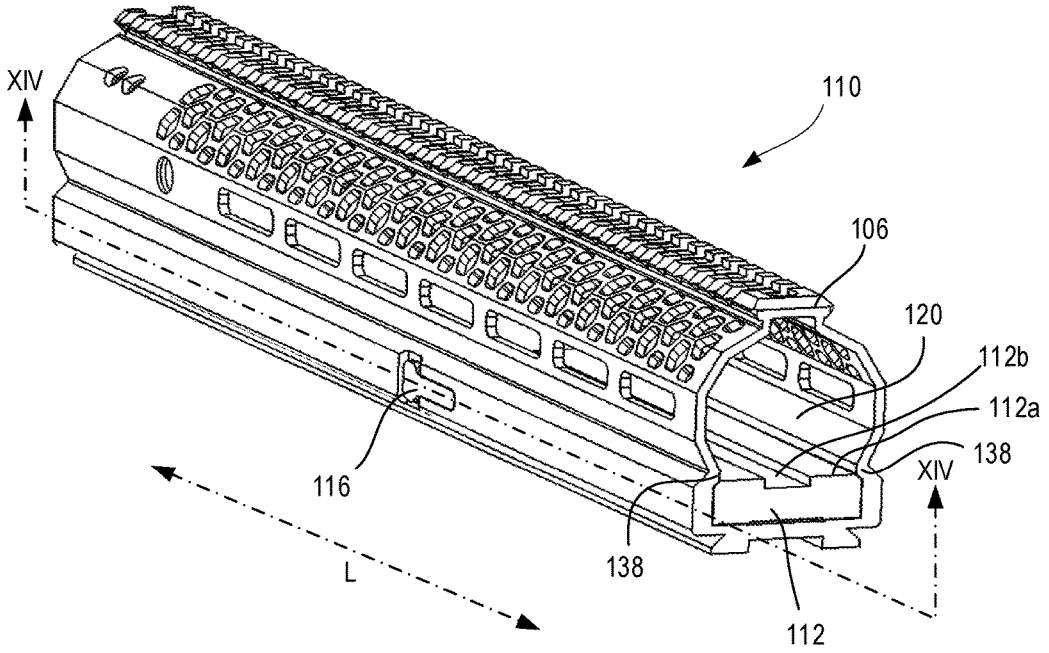
FIG. 9 is an isometric view of another embodiment of an adjustable firearm balance weight system, shown in an assembled state.

FIGS. 8A and 8B show an example of a balance weight 112 with exemplary mechanisms forming protrusions 114 and lock release 116. For clarity in the illustrations, some duplicate features (e.g., protrusions 114) are not numbered. In this example, protrusions 114 are provided as pins that are slidably mounted within corresponding bores 124 through balance weight 112. Bores 124 extend generally perpendicular to the length of balance weight 112 from an outer surface of balance weight 112 to a longitudinal bore 126 extending through balance weight 112.

Lock release 116 comprises a shaft 128 that extends into longitudinal bore 126 from one longitudinal end of balance weight 110. Shaft 128 has relatively wide regions 130' and relatively narrow regions 130", which can be selectively aligned with protrusions 114, as explained below. A spring 132 is provided between an end of shaft 128 and a closed end 134 of longitudinal bore 126, and configured to bias shaft 128 away from closed end 134. Protrusions 114 and shaft 128 are captured within their respective bores 124, 126 by respective retainers 136, such as threaded or press-fit rings having an opening that is too small to allow the entire protrusions 114 and shaft 128 to pass through.

Lock release 116 is operable to place protrusions 114 into two operative positions. In the first position, shown in FIG. 8A, lock release 116 is in a locked state, in which the wide regions 130' of the shaft 128 are positioned to hold protrusions 114 with their free ends extending relatively far from the outer surface of balance weight 112. In this position, protrusions 114 can extend into corresponding detents (not shown in FIGS. 8A and 8B), to hold balance weight 112 in a fixed location along the length of the firearm. In the second position, shown in FIG. 8B, lock release 116 is in an unlocked state, in which narrow regions 130" of shaft 128 are positioned to allow protrusions 114 to retract into bores 124 to move their free ends closer to (or flush with) the outer surface of balance weight 112 to disengage from detents 118. In the unlocked state, balance weight system 110 can be moved along the length of the firearm to a new position. The spring 132 biases shaft 128 towards the locked state, so when protrusions 114 are aligned with corresponding detents 118, shaft 128 can move into the locked state.

It will be understood that embodiments of lock release 116 and protrusions 114 could be modified in various ways. For example, lock release 116 could extend from both longitudinal ends of balance weight 112 to provide adjustment from either end, or to allow a user to insert either end of balance weight assembly 110 into a corresponding chamber 120. Lock release 116 also could be located on the side of balance weight 112, or in other locations. As another example, protrusions 114 may be replaced by balls. Spring 132 also may be relocated to other positions. Lock release 116 also may comprise a double acting mechanism (e.g., a dual-acting cam and follower) that affirmatively pulls and pushes protrusions 114 between their operative positions. Also, features of protrusions 114 and lock release 116 could be located on the firearm, rather than balance weight 112, so as to provide an arrangement exemplified by balance weight system 110' in FIG. 7. It will also be understood that protrusions 114 and lock release 116 could comprise different structures. For example, protrusions 114 may comprise a rotating cam having an eccentric surface that extends and retracts from balance weight 112 as the cam is rotated, and the lock release 116 may comprise a lever that turns the cam to engage a detent. In other cases, lock 114 may be configured to hold balance weight 112 in place by friction or brute force (e.g., a cam that presses against an adjacent surface), and the detent may be omitted. In this case, balance weight system 110 may be positioned at virtually any location along the firearm's length, as compared to the discrete locations provided by embodiments using detents 118. Lock release 116 also may include features such as an activation lock that prevents lock release 116 from operating until the activation lock is deactivated. Other alternatives and embodiments will be apparent to persons of ordinary skill in the art in view of the present disclosure.

FIGS. 9 to 14 show another embodiment of an adjustable firearm balance weight system 110. In this case, the balance weight system 110 is provided as an assembly of a hand guard 106 and a balance weight 112 that is slidably mounted to hand guard 106 and securable at different locations along sliding axis L. Balance weight 112 is mounted within second region 120*b* of internal chamber 120. Second region 120*b* is located adjacent to first region 120*a*, and first region 120*a* surrounds barrel 122 when the hand guard 106 is attached to a rifle. Balance weight 112 has a generally rectangular profile (i.e., two pairs of opposed parallel sides with each pair at right angles to the other pair) as viewed along sliding direction L. A rectangular shape is preferred as it facilitates machining from conventional bar stock, but other shapes may be used.

Second region 120*b* is open to first region 120*a*, and includes a narrowed region defined by one or more internal rails 138. The structure defining the narrowed region (e.g., rails 138) are shaped to prevent balance weight 112 from moving from second region 120*b* to first region 120*a*. As will be appreciated from the foregoing, balance weight 112 may be exposed to significant heat emanating from barrel 122 during operation of the firearm. Thus, an upper surface 112*a* of balance weight 112 may include a recess 122*b* to increase the volume of free space between barrel 122 and balance weight 112. For example, upper surface may have a recess 122*b* in the shape of a rectilinear groove (such as shown), a curved concave surface, and so on.

Figure 10:
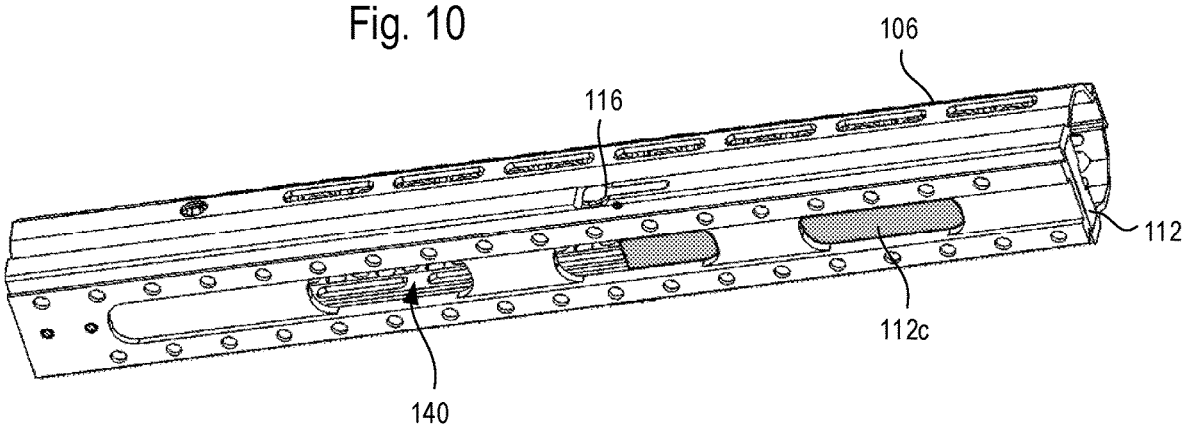
FIG. 10 is another isometric view of the embodiment of FIG. 9.
Figure 12:
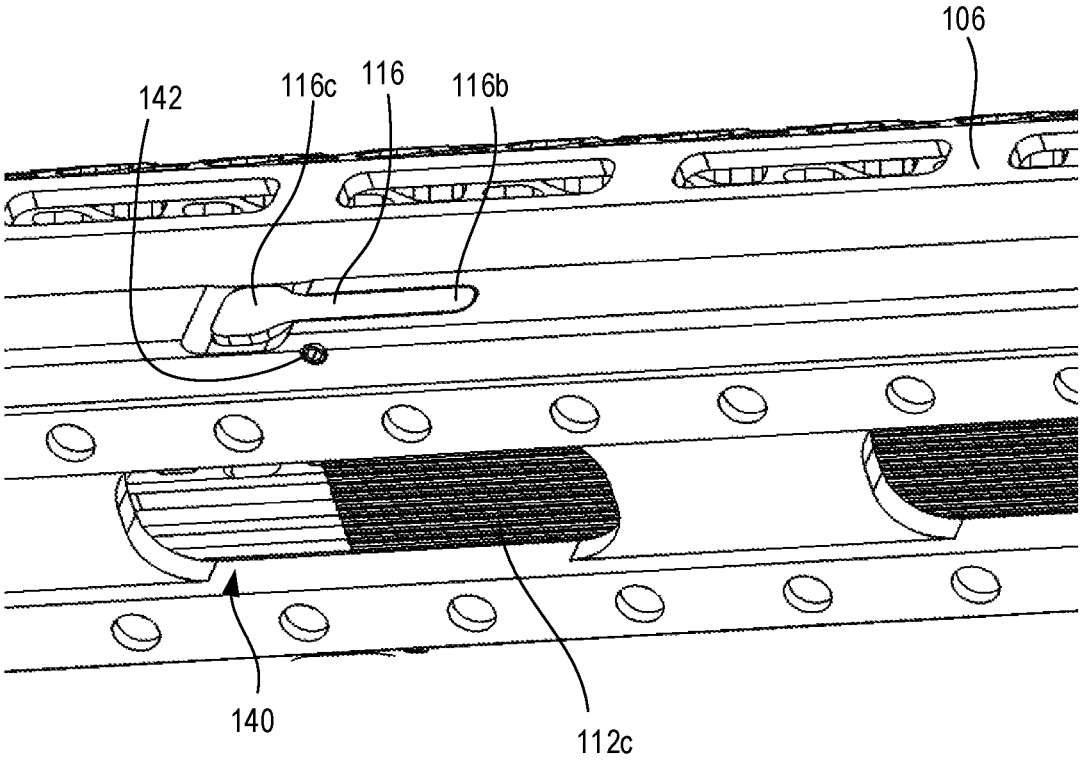
FIG. 12 is a partial isometric view of the embodiment of FIG. 9, detailing a balance weight release lever.

As shown in FIGS. 10 and 12, hand guard 106 may include one or more holes 140 that extend from an exterior of the hand guard 112 into second region 120*b*. Holes 140 are positioned and dimensioned to provide a user with access to move balance weight 112. To this end, holes 140 preferably are dimensioned to receive a user's finger (e.g., at least 0.375 inches wide, and more preferably at least 0.5 inches wide), and may be elongated to allow the user to guide balance weight 112 to a desired position along the sliding axis L. Holes 140 also may provide additional ventilation for hand guard 106. Balance weight 112 also may include a textured surface 112*c* facing holes 140. Textured surface 112*c* is configured to increase grip between a user and balance weight 112. For example, textured surface 112*c* may comprise a knurled surface, ribs that extend along or at an angle to sliding axis L, and so on.

Balance weight 112 is selectively secured to hand guard 106 along sliding direction by a lock release 116 in the form of one or more levers 116 that are pivotally mounted to hand guard 106. One lever 116 is visible in the drawings on a lateral side of hand guard 106. Another lever may be located on an opposite lateral side of hand guard 106 as a mirror image of the shown lever 116. Lever 116 is mounted to hand guard 106 by a pivot pin 142. For example, pivot pin 142 may comprise a smooth pivot portion 142*a* that extends through a corresponding bore 116*a* in lever 116, and a threaded head 142*b* that engages a threaded bore 144 in hand guard 106 to hold pivot pin 142 in place. This construction reduces the part count and facilitates service. Pivot pin 142 defines a pivot axis P that extends perpendicular to sliding axis L, but this is not strictly required.

Lever 116 includes a protrusion 114 that is radially offset from pivot axis P at a first location 116*b*, and a button 146 that is radially offset from pivot axis P at a second location 116*c*. Protrusion 114 may be positioned anywhere that it can engage corresponding detents 118 in balance weight 112. Button 146 can be positioned anywhere that it can be operated by a user. In the shown example, lever 116 extends along a lever axis A from protrusion 114 at the first location 116*b* to button 146 at the second location 116*c*, and pivot axis P is located between protrusion 114 and button 146 to form a "first class" type lever. Other embodiments may use other arrangements (e.g., protrusion 114 and button 146 located relative to pivot axis P to define a "second class" or "third class" lever).

Figure 11:
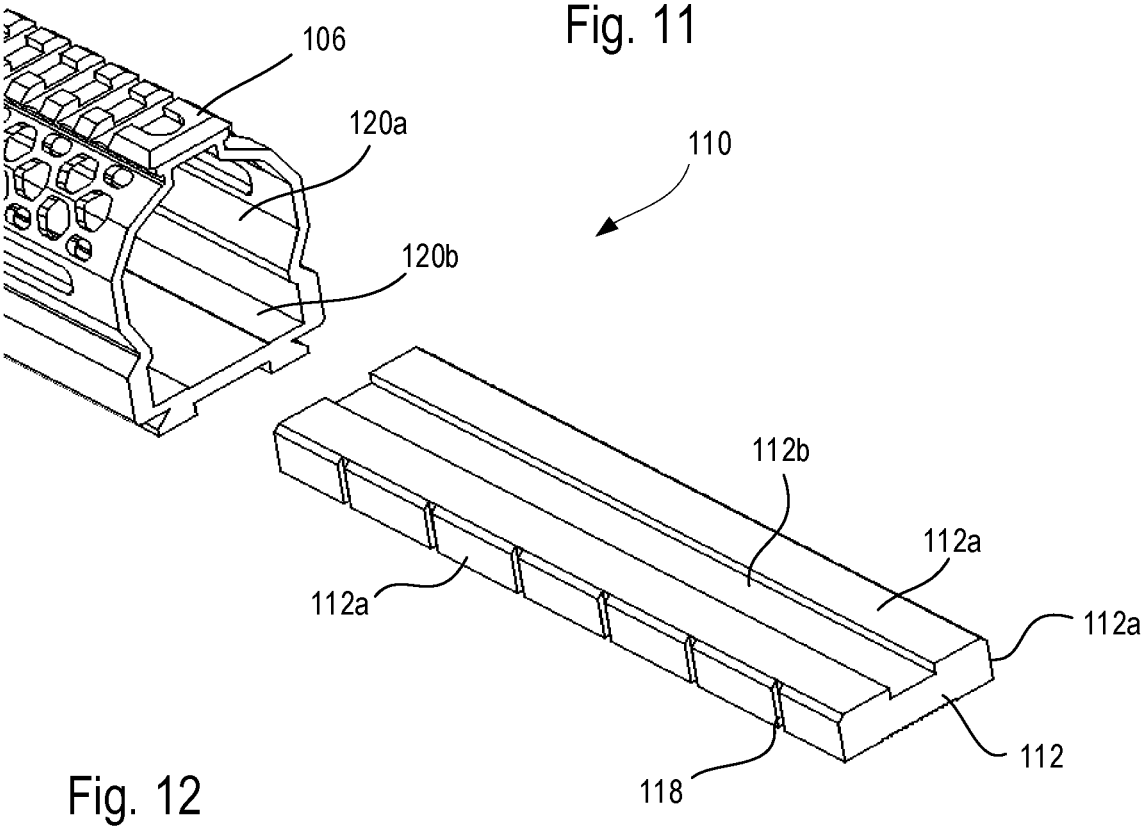
FIG. 11 is a partial isometric view of the embodiment of FIG. 9, shown with the balance weight removed.
Figure 13:
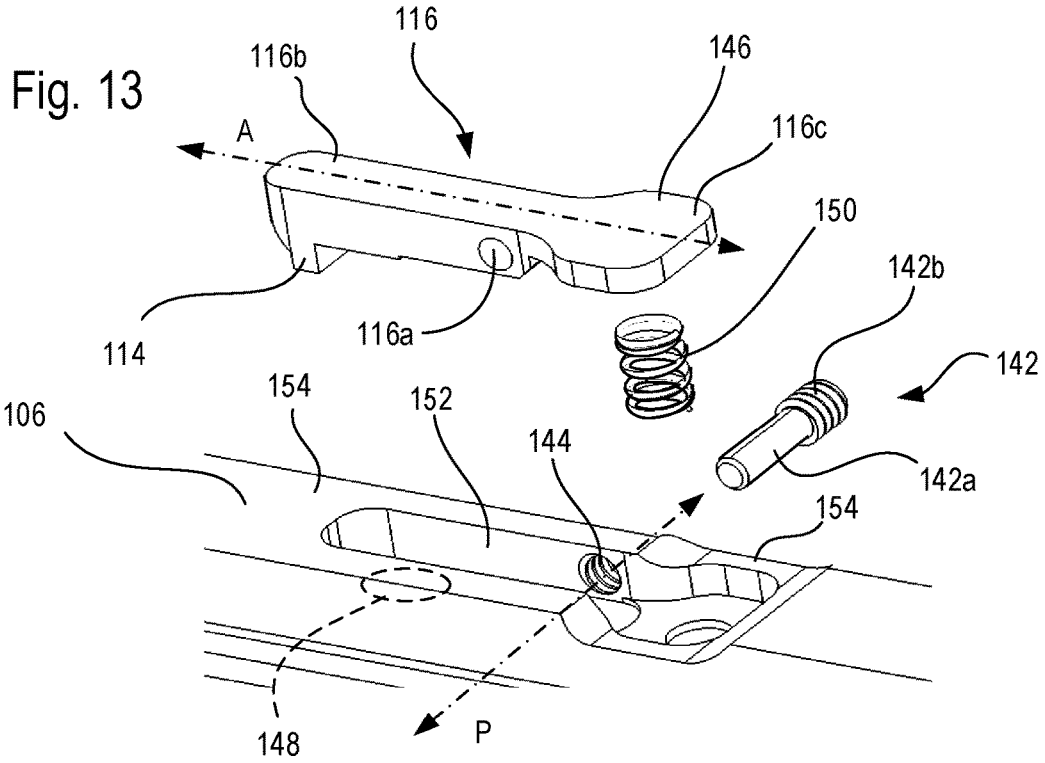
FIG. 13 is an exploded view of the balance weight release lever of FIG. 12.
Figure 14:
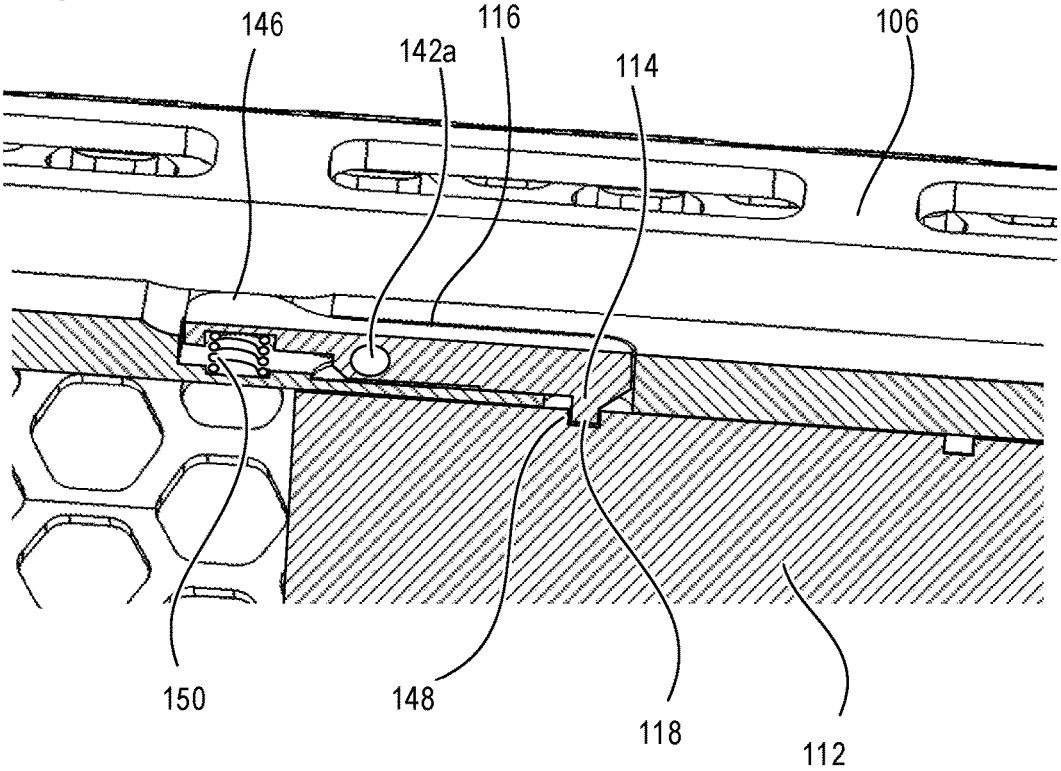
FIG. 14 is a cross-section view of the balance weight release lever of FIG. 12.

As shown in FIGS. 13 and 14, protrusion 114 is positioned to extend through an opening 148 that passes through hand guard 106 and into second region 120*b* of chamber 120. Inside chamber 120, protrusion 114 can engage one of a plurality of detents 118 that are spaced in sliding direction L along a side of balance weight 112. FIG. 11 shows detents 118 on one side of balance weight 112, and a second row of detents 118 may be provided at other locations, such as an opposite side of balance weight 112. As will be appreciated from the foregoing, lever 116 can be rotated about pivot axis P by depressing button 146, and, upon doing so, protrusion 114 moves backwards to retract from chamber 120 and detent 118. Thus, balance weight 112 can be disengaged by hand and without tools. However, a safety lock or fixing mechanism may be provided if desired. For example, a screw may be provided to hold the lever 116 with protrusion 118 engaged with detent 116.

A spring 150 may be provided to rotate lever 116 in the reverse direction, to move protrusion 114 back into chamber 120 and into any detent 118 that is aligned with protrusion 114 at the time. This allows the user to simply release button 146 and slide balance weight 112 to automatically lock into place at the next alignment of detent 118 with protrusion 114. Spring 150 is shown as a coil spring that fits between lever 116 at button 146 and hand guard 106. Other embodiments may use other types of spring 150. For example, spring 150 may a leaf spring or a resilient plastic or rubber substance. Spring 150 also may be integrated into one or more other parts. For example, spring 150 may be formed by pivot pin 142, such as by forming pivot portion 142*a* as a torsion spring. Other alternatives and embodiments will be apparent to persons of ordinary skill in the art in view of the present disclosure.

Lever 116 (or levers 116) may be positioned at any usable location along hand guard 106. For example, a first lever 116 as described above may be located on one lateral side of hand guard 106 (e.g., at approximately a midpoint along the length of hand guard 106), and a second lever 116 may be provided as a mirror image of the first lever 116 on an opposite lateral side of hand guard 106 along to sliding axis L. Second region 120*b* of chamber 120 is located between the two levers 116. Balance weight 112 has a row of first detents 118 spaced along sliding axis L on a first side face 112*d* of balance weight 112, and a row of second detents 118 spaced along sliding axis L on a second side face 112*e* of balance weight 112. In use, buttons 146 of the two levers 116 may be depressed simultaneously be squeezing them together towards balance weight 112 with one hand, thus releasing balance weight 112 to be moved to a new position.

Lever 116 also may be configured to help avoid inadvertent release. For example, layer 116 may be enclosed by a cover or provided with a lock. In the embodiment of FIGS. 9 to 14, lever 116 is at least partially protected from accidental release by locating lever 116 in a recess 152 formed in the side of hand guard 106. Recess 152 extends into an adjacent portion of an outer face 154 of hand guard 106. Lever 116 and recess 152 are dimensioned such that lever 116 is flush with or below some or all of the adjacent portion of outer face 154 when lever 116 is in the engaged position (i.e., with protrusions 118 extending into chamber 120). In the shown example, button 146 may be adjacent to a depressed portion 154*a* of outer face 154 to allow button 146 to be depressed more easily. However, a majority of lever 116, including second location 116*c*, is flush with or below the adjacent portion of outer surface 154. Return spring 150 captured in place between button 146 and an adjacent portion of recess 152. Other alternatives and embodiments will be apparent to persons of ordinary skill in the art in view of the present disclosure.

In addition to allowing relatively simple repositioning of balance weight 112, the foregoing embodiments may also allow the user to remove balance weight 112 by sliding it through an open end of chamber 120. This facilitates cleaning, replacing balance weight 112 with a larger or smaller weight, and so on.

The foregoing are examples of a balance weight system that may be implemented to move a balance weight forward and backwards along the length of a firearm, without requiring any kind of tool to do so. This allows the user to quickly and easily adjust the balance weight forward or backward to balance the firearm as desired. Embodiments also may provide a safe and secure means for attaching the balance weight to the firearm in a manner that overcomes concerns about accidental release or movement of the balance weight.

This description and the accompanying drawings are provided as non-exclusive examples, and the claimed invention is not intended to be narrowly construed to require any particular described or illustrated features except as specifically set forth in the claims. It will also be understood that features and configurations described herein can be used interchangeably as desired, without changing the general principle of operation (e.g., the embodiment of FIGS. 4A-6 can be modified to locate lock 114 and lock release 116 on the firearm and detents 114 on the balance weight, as shown in one of the embodiment of FIG. 7). All such modifications are within the scope of the invention, and other alternatives and embodiments will be apparent to persons of ordinary skill in the art in view of the present disclosure.

The invention claimed is:

1. An adjustable firearm balance weight system comprising:

a balance weight configured to be secured within a part of a firearm in at least two alternative positions relative to the part of the firearm; and a lock system configured to engage the balance weight in each of the at least two alternative positions relative to the part of the firearm, wherein the lock system is configured to allow the balance weight to move between the at least two alternative positions;

wherein the lock system is configured to be operated by hand and without tools; and wherein the part of the firearm comprises an internal chamber configured to receive the balance weight to move relative to the part of the firearm along a sliding direction.

2. The adjustable firearm balance weight system of claim 1, wherein the internal chamber comprises a first region configured to surround a barrel of the firearm, and a second region adjacent to the first region and configured to slidingly receive the balance weight.

3. The adjustable firearm balance weight system of claim 2, wherein the first region and the second region are open to each other.

4. An adjustable firearm balance weight system comprising:

a balance weight configured to be secured within a part of a firearm in at least two alternative positions relative to the part of the firearm; and a lock system configured to engage the balance weight in each of the at least two alternative positions relative to the part of the firearm, wherein the lock system is configured to allow the balance weight to move between the at least two alternative positions, wherein the part of the firearm comprises an internal chamber configured to receive the balance weight to move relative to the part of the firearm along a sliding direction, wherein the internal chamber comprises a first region configured to surround a barrel of the firearm, and a second region adjacent to the first region and configured to slidingly receive the balance weight, wherein the first region and the second region are open to each other, and wherein the internal chamber comprises a narrowed region between the first region and the second region, and the narrowed region is configured to prevent the balance weight from moving from the second region to the first region.

5. The adjustable firearm balance weight system of claim 3, wherein the balance weight comprises a surface facing the barrel, and the surface facing the barrel comprises a recess extending away from the barrel to increase a volume of free space between the barrel and the balance weight.

6. The adjustable firearm balance weight system of claim 1, wherein the part of the firearm comprises one or more holes positioned along the sliding direction and extending from an exterior of the part of the firearm to the internal chamber, and wherein the holes are dimensioned to provide access to move the balance weight from outside the part of the firearm.

7. The adjustable firearm balance weight system of claim 6, wherein the balance weight has a surface facing the holes, and surface facing the holes comprises a textured surface configured to increase grip between a user and the balance weight.

8. The adjustable firearm balance weight system of claim 1, wherein the balance weight and the lock system comprise:

one or more movable protrusions located on one of the balance weight and the part of the firearm; and a plurality of detents located on the other of the balance weight and the part of the firearm, wherein the plurality of detents are configured to receive the one or more movable protrusions in different interlocking arrangements corresponding to the at least two alternative positions.

9. An adjustable firearm balance weight system comprising:

a balance weight configured to be secured within a part of a firearm in at least two alternative positions relative to the part of the firearm; and a lock system configured to engage the balance weight in each of the at least two alternative positions relative to the part of the firearm, wherein the lock system is configured to allow the balance weight to move between the at least two alternative positions, wherein:

the balance weight configured to slide between the two positions; and the lock system comprises:

lock mounted to the part of the firearm, wherein the lock is movable without the use of a tool from a first position in which the lock engages the weight, and a second position in which the lock does not engage the weight.

10. The adjustable firearm balance weight system of claim 9, wherein the lock system comprises:

a lever pivotally mounted to a part of the firearm to rotate about a pivot axis, a protrusion connected to a lever at a first location offset radially from the pivot axis, a button connected to the lever arm at a second location offset radially from the pivot axis, and the lever extends along a lever axis from the first location to the second location, and the pivot axis is between the protrusion and the button.

11. The adjustable firearm balance weight system of claim 10, wherein:

the part of the firearm comprises a recess extending into an adjacent portion of an outer face of the part of the firearm; and the lever, the protrusion and the button are located within the recess and flush with or below some or all of the adjacent portion of outer face when the lever is in the first position.

12. The adjustable firearm balance weight system of claim 10, further comprising return spring configured to bias the lever towards the first position.

13. An adjustable firearm balance weight system comprising:

a balance weight configured to be secured within a part of a firearm in at least two alternative positions relative to the part of the firearm; and a lock system configured to secure engage the balance weight in each of the at least two alternative positions relative to the part of the firearm, wherein the lock system is configured to allow the balance weight to move between the at least two alternative positions, wherein:

the balance weight is attached to the part of the firearm to slide along a sliding axis within a passage defined by the part of the firearm, and comprises a plurality of first detents spaced along the sliding axis on a first face of the balance weight and a plurality of second detents spaced along the sliding axis on a second face of the balance weight; and the lock system comprises:

a first protrusion mounted to the part of the firearm on a first side of the passage and movable between a respective first position in which the first protrusion extends into the passage to engage a first detent, and a respective second position in which the first protrusion does not extend into the passage to engage the first detent; and a second protrusion mounted to the part of the firearm on a second side of the passage and movable between a respective first position in which the second protrusion extends into the passage to engage a second detent, and a respective second position in which the second protrusion does not extend into the passage to engage the second detent, and wherein the first protrusion is mounted on a first lever having a first button that is movable towards the balance weight to move the first protrusion to the respective second position, and the second protrusion is mounted on a second lever having a second button that is movable towards the balance weight to move the second protrusion to the respective second position.

* * * * *